US007234907B1

(12) United States Patent
Artrip

(10) Patent No.: US 7,234,907 B1
(45) **Date of Patent: *Jun. 26, 2007**

(54) SYSTEM FOR FORMING AND SECURING LIFT-TABS TO CAN ENDS HAVING A DRIVE BELT

(75) Inventor: Donald Artrip, Bluff City, TN (US)

(73) Assignee: Jerry Artrip, Bluff City, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/406,563

(22) Filed: Apr. 19, 2006

Related U.S. Application Data

(60) Division of application No. 10/756,643, filed on Jan. 13, 2004, now Pat. No. 7,063,492, which is a continuation-in-part of application No. 09/731,547, filed on Dec. 8, 2000, now Pat. No. 6,682,286, which is a continuation-in-part of application No. 09/221,397, filed on Dec. 28, 1998, now abandoned, which is a continuation of application No. 08/711,509, filed on Sep. 10, 1996, now Pat. No. 6,022,179, which is a continuation-in-part of application No. 08/014,268, filed on May 12, 1993, now Pat. No. 5,660,516.

(51) Int. Cl.
*B21D 51/44* (2006.01)

(52) U.S. Cl. ..... 413/66; 413/14

(58) Field of Classification Search ..... 413/8, 413/12, 14, 16, 25, 56, 66, 70; 72/405.01, 72/405.06; 29/429, 430, 801
See application file for complete search history.

(56) References Cited

U.S. PATENT DOCUMENTS

| | | | | |
|---|---|---|---|---|
| 1,707,107 | A * | 3/1929 | Wright | 29/432.2 |
| 4,026,226 | A * | 5/1977 | Hahn et al. | 413/8 |
| 4,568,230 | A * | 2/1986 | Brown | 413/66 |
| 5,511,920 | A * | 4/1996 | Artrip | 413/25 |
| 5,660,516 | A * | 8/1997 | Artrip et al. | 413/14 |
| 6,682,286 | B1 * | 1/2004 | Artrip | 413/66 |
| 6,802,683 | B2 * | 10/2004 | Turner et al. | 413/8 |
| 7,063,492 | B1 * | 6/2006 | Artrip | 413/66 |

* cited by examiner

*Primary Examiner*—Lowell A. Larson

*Assistant Examiner*—Jimmy Nguyen

(57) ABSTRACT

A system for forming and attaching lift-tabs to can ends to form easy opening lift-tab can ends comprises a frame and a tab press for forming a lift-tab. The system also includes a drive roller adapted to move the strip of metal stock material through the tab press. The system further includes a conversion press for attaching a lift-tab onto a can end, a conveyor, a power source including a tab press power source, and a crank shaft operatively connected to the tab press power source. The crank shaft is adapted to transmit power for operating either or both of the tab press and the conversion press. The tab press crank shaft and the conversion press crank shaft are connected to each other by a drive belt.

2 Claims, 11 Drawing Sheets

SYSTEM FOR FORMING AND SECURING LIFT-TABS TO CAN ENDS HAVING A DRIVE BELT

CROSS-REFERENCES TO RELATED APPLICATIONS

This application is a divisional of the continuation-in-part Ser. No. 10/756,643, filed on Jan. 13, 2004, now U.S. Pat. No. 7,063,492, which is entitled SYSTEM FOR FORMING AND ATTACHING LIFT-TABS TO CAN ENDS, which is a continuation-in-part of the co-pending patent application Ser. No. 09/731,547, filed on Dec. 8, 2000, now U.S. Pat. No. 6,682,286, which is entitled SYSTEM AND METHOD FOR FORMING LIFT-TAB CAN END ASSEMBLES, which is a continuation-in-part of patent application Ser. No. 09/221,397, filed on Dec. 28, 1998 (now abandoned), which is entitled SYSTEM AND METHOD FOR FORMING LIFT-TAB CAN END ASSEMBLIES, which is a continuation of application Ser. No. 08/711,509 filed on Sep. 10, 1996, now U.S. Pat. No. 6,022,179, which is entitled SYSTEM AND METHOD WHEN FORMING LIFT-TAB CAN ASSEMBLIES, which is a continuation-in-part of application Ser. No. 08/014,268, filed May 12, 1993, now U.S. Pat. No. 5,660,516, which is entitled TURNING EASY OPEN CAN TOP TABS OVER AUTOMATICALLY WHEN THESE TABS ARE MADE UPSIDE DOWN.

FIELD OF THE INVENTION

The present invention relates to containers for the food and beverage industry, and particularly to those food and beverage containers or cans which have lift-tab assemblies.

BACKGROUND AND DESCRIPTION OF THE PRIOR ART

In the production of lift-tab can ends (also known as "easy-open" can ends), the lift-tab is conventionally formed rough-side-up or bottom-side-up. Consequently, it has been necessary to invert the tabs so that they are positioned smooth-side-up, prior to their attachment to can ends. This inversion has generally been accomplished manually, and therefore, it is desirable to provide a method wherein the tab is inverted automatically, thereby saving labor. Alternatively, it is desirable to provide a method of production wherein the lift-tab is formed rough-side-down or top-side-up, thereby eliminating the need for inversion of the lift-tab altogether.

Presses for attaching a lift tab to a can end (known in the industry as "converting" the end to an easy-open can end) are known. Presses of this type are available from the Minister Machine Company of Minister, Ohio. U.S. Pat. No. 4,568,230 shows a layout of a press for processing workpieces into finished can ends with an opening tab attached thereto.

Presses used for the manufacture of easy-open can ends generally comprise a press bed mounted on legs which rest on the floor. Four columns or uprights are mounted on the press bed. The columns or uprights support a crown in which a main drive for the press components is mounted. The columns have slides attached therein for supporting a reciprocating main ram. The main ram carries the upper tooling of the main die set, which cooperates with lower tooling on the bed. The main die set defines a plurality of stations in which the can ends are progressively converted into easy-open can ends. A conveyor carries the can ends into and through the stations of the die set. The tabs are formed by tab tooling, which is supplied with strip stock by a stock feed device. The tab tooling forms a tab and separates it from the strip stock for attachment to a can end.

The tab tooling has conventionally been mounted on the press bed laterally of the conveyor and laterally of the main die. The tab tooling may also be split so that it is arranged laterally on both sides of the main die. A bridge is required to transfer the tab stock strip across the main die set. Such an arrangement is shown in U.S. Pat. No. 4,568,230. The upper tooling is mounted on the main ram of the press.

One of the deficiencies associated with this arrangement of the tooling is that it is difficult to access the tooling for maintenance. Access to the can end tooling is difficult due to the presence of the tab tooling on one side of the main die and the tab tooling and tab stock feed device on the other side of the main die. The lateral placement of the tab tooling also increases the depth of the press from front to back. This requires a larger bed which increases the weight of the press and reduces its speed.

ADVANTAGES OF THE INVENTION

The present invention overcomes the disadvantages of the laterally-placed, split tab tooling by locating the tab tooling in another press where the only tooling is the tooling associated with the tab press. Placing the tab die set in another press allows full access to the main die from either the front or back of the press. Neither the tab tooling or its stock feed device obstruct access to the main die set. This placement of the tab tooling also permits a reduction in the width of the press between the columns and thus a reduction in weight of the press which allows the press to run at a higher speed. Another benefit of the tab tooling placement of the present invention is that it allows servicing of the tab die within the press. Still another benefit of placing the tab tooling and the can end tooling in separate presses is that there can be an additional tab press ready for substitution into the production line at any time a tab press in operation breaks down or needs to be shut down for repairs. The advantage of the present invention is increased productivity through higher operating speed and reduced down time for maintenance and tab press stock-up.

EXPLANATION OF TECHNICAL TERMS

As used herein, the term "rivet" refers to any structure which protrudes, projects or extends from a first object such that the structure may be received by a hole, opening or aperture in a second object. The term "rivet" further contemplates that the structure protruding, projecting or extending from the first object may be bent, depressed, deformed or otherwise manipulated after it is received by the hole, opening or aperture in the second object such that the structure attaches or connects the second object to the first object.

SUMMARY OF THE INVENTION

The invention comprises a process and system for use in forming lift-tab can end assemblies, wherein each lift-tab can end assembly includes a lift-tab having a smooth side, an opposite roughened side, a hole extending between the sides of the lift-tab, and a rivet or shaft, extending from the can end, adapted to receive the hole in the lift-tab, during an assembly-forming process.

A preferred embodiment of my invention provides a first press machine which makes the can end and a second press machine, or tab press, which makes the can end lift-tab. A third press machine, or conversion press, is provided which attaches the lift-tab to the can end to form lift-tab can ends. In this embodiment of the invention, all three of the press machines are separate machines. Can ends are generally advanced from the first press to the third press by means of a conveyor.

Unlike many of the devices of the prior art, my invention does not provide a tab punch disposed at the exit of the tab press to remove the tab from the strip of material from which it is made, but rather accomplishes this task later in the lift-tab attachment process. By deferring the punching of the lift-tabs from the strip at the tab press exit, the strip as a whole may be inverted rather than necessitating the inversion of each individual lift-tab. To accomplish the inversion of the metal strip in a preferred embodiment of the invention, a drive roller is provided on the frame of the tab press that rolls the strip of metal stock material, with the formed lift-tabs loosely attached, across a series of rollers or through a guide which inverts the metal strip via either a half twist or a half loop rotation in the guide or on the rollers. Alternatively, a tab press including a die which presses tabs rough-side-down or top-side-up may be utilized. When such a tab press is utilized, it is no longer necessary to invert the lift-tabs by way of a half loop or half twist prior to their introduction into a conversion press. Thus, the invention contemplates two alternative methods of placing the lift-tabs into the proper position for attachment to the can ends.

In addition, the invention describes alternative methods of routing the lift-tabs through the process. In one embodiment of the invention, the strip of metal stock material with the formed lift-tabs loosely attached is run through a locating means so that the strip will go into the conversion press with the lift-tabs being properly positioned with respect to a can end such that the conversion press may, in the same motion, detach the tab from the strip and attach the tab to the can end to form a lift-tab can end. In a second embodiment, a strip of metal stock material with lift-tabs formed therein is passed through a tab punching station where a tab punch knocks the formed tabs from the strip of metal stock material into a number of lanes with the smooth side of the tabs facing up. The lift-tabs then slide or are conveyed from the punching station to a conversion press. Since the production of the lift-tabs is commonly quicker than the attachment of the lift-tabs to the can ends, the lift-tabs will accumulate in their lanes adjacent to the conversion press. In this embodiment of the invention, the conversion press has attached thereto a tab ejector which feeds one lift-tab from the lane of tabs into the conversion press and properly positions the tab with respect to the can end so that as the conversion press takes a downstroke, the lift-tab is attached to the can end.

This invention provides for the use of any number of commercially available conversion presses. Additionally, the tab press is capable of operating such that a plurality of lift-tabs are created along a width of the strip of metal stock material. Furthermore, it is possible for the tab press to be operated with several lift-tab forming heads operating on a plurality of strips of metal stock material running alongside of one another in the tab press.

In the case where a single strip of metal stock material is pressed so that there are multiple tabs formed across its width, to avoid having to punch the tabs out of the strip prior to entering a conversion press or having to route the strip to a number of different conversion presses, the user can insert a commercially available plasma cutter or another conventional cutter which will precisely cut the wide strip of formed lift-tabs into individual strips of lift-tabs enabling the individual strips to be conveyed to and pass through a conversion press in the manner described above.

Another version of the second method of producing separate strips with one lane of formed lift-tabs in each strip is to provide a tab press with tooling which separates the single strip of metal stock material into individual strips and forms lift-tabs in each individual strip.

An alternative scheme involving the routing of separate tab-formed strips to their designated conversion presses is to pass a plurality of individual strips of stock material through the tab press in such a manner that the tab press produces separate strips with one lane of formed lift-tabs in each strip. This method of operation provides that if one or more of the conversion presses becomes inoperative, then the tab strip intended for use with that conversion press can be taken out of the inoperative press or presses and all other presses can continue to run. Separate paths through the press as well as separate guide means which route the strips along the separate paths would be necessary when utilizing the separate and individual tab formed strips. Each strip of stock material can be propelled through the tab press by a commercially available feeder such as a Ferguson Camtrol roll feed. A second roll or drive feed can be inserted to advance the tab formed strips on to the designated conversion presses.

One embodiment of the process includes a step of conveying a strip of metal stock material containing lift-tab forms from the tab press to a conversion press, during which conveyance the metal strip is inverted by passage along or through a half-loop of about 180 vertical degrees, or a half-twist of about 180 degrees, so that the strip of metal stock material is inverted from the orientation it had when it emerged from the tab press. The inverted strip of metal stock material is then conveyed into the conversion press, where each tab is separated from the strip of metal stock and attached to the can end in the same motion of the conversion press.

The length of the run between the tab press and the conversion press will determine whether any guide means are required to support the strip of metal stock.

The system of the invention includes means for advancing formed can ends through a first workstation so that as the can ends are advanced therethrough, the shafts or rivets formed therein protrude generally upward. Means are also included for conveying a strip of metal stock through a tab press wherein a first press means is provided for stamping lift-tab forms into the strip of metal stock so that the lift-tabs are loosely attached to the remainder of the strip and are oriented smooth-side-down as they exit the tab press. The conveying means is adapted to direct the strip stock which has been stamped with the lift-tab forms along a path through which the strip stock is inverted, so that as each lift-tab moves into the conversion press, the lift-tab is positioned smooth-side up.

In an alternative embodiment, the step of inverting the lift-tabs by about 180° is eliminated through the use of a tab press having a die arranged such that the lift-tabs are punched rough-side-down or top-side-up.

The system also includes means for directing the lift-tab formed strip to a position such that a lift-tab is disposed above a can end positioned in the conversion press. The directing means is coordinated with the can end conveying means so that as each can end is advanced into the attachment position at the conversion press, a lift-tab within the strip of metal is moved above the can end so that the hole in the lift-tab is positioned directly above the upwardly-directed shaft or rivet formed in the can end.

The invention comprises a system for forming and attaching lift-tabs to can ends to form easy opening lift-tab can ends. The system comprises a frame and a means for forming a lift-tab. The means for forming a lift-tab is mounted on the frame and adapted to form at least one lane of lift-tabs in a strip of metal stock material. The system also includes a drive roller supported on the frame and adapted to move the strip of metal stock material through the means for forming a lift-tab. The system further includes a means for attaching a lift-tab onto a can end. The means for attaching a lift-tab onto a can end is mounted on the frame and adapted to attach a lift-tab onto a can end to form an easy opening lift-tab can end. The system also includes a conveyor means for conveying the at least one lane of formed lift-tabs from the means for forming a lift-tab to the means for attaching a lift-tab onto a can end, a power source for providing power to operate either or both of the means for forming a lift-tab and the means for attaching a lift-tab onto a can end, and a crank shaft operatively connected to the power source. The crank shaft is adapted to transmit power for operating either or both of the means for forming a lift-tab and the means for attaching a lift-tab onto a can end.

In a preferred embodiment of the system for forming and attaching lift-tabs on can ends, the system comprises a first frame on which a tab press is mounted and a second frame on which a conversion press is mounted. The preferred tab press is adapted to form at least one lane of lift-tabs in a strip of metal stock material. The preferred conversion press is adapted to attach a lift-tab onto a can end. More particularly, the preferred conversion press is adapted to attach lift-tabs from the at least one lane of lift-tabs formed by the tab press onto a plurality of can ends, one tab per can. Also in the preferred embodiment, the first frame and the second frame are in close proximity to each other.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
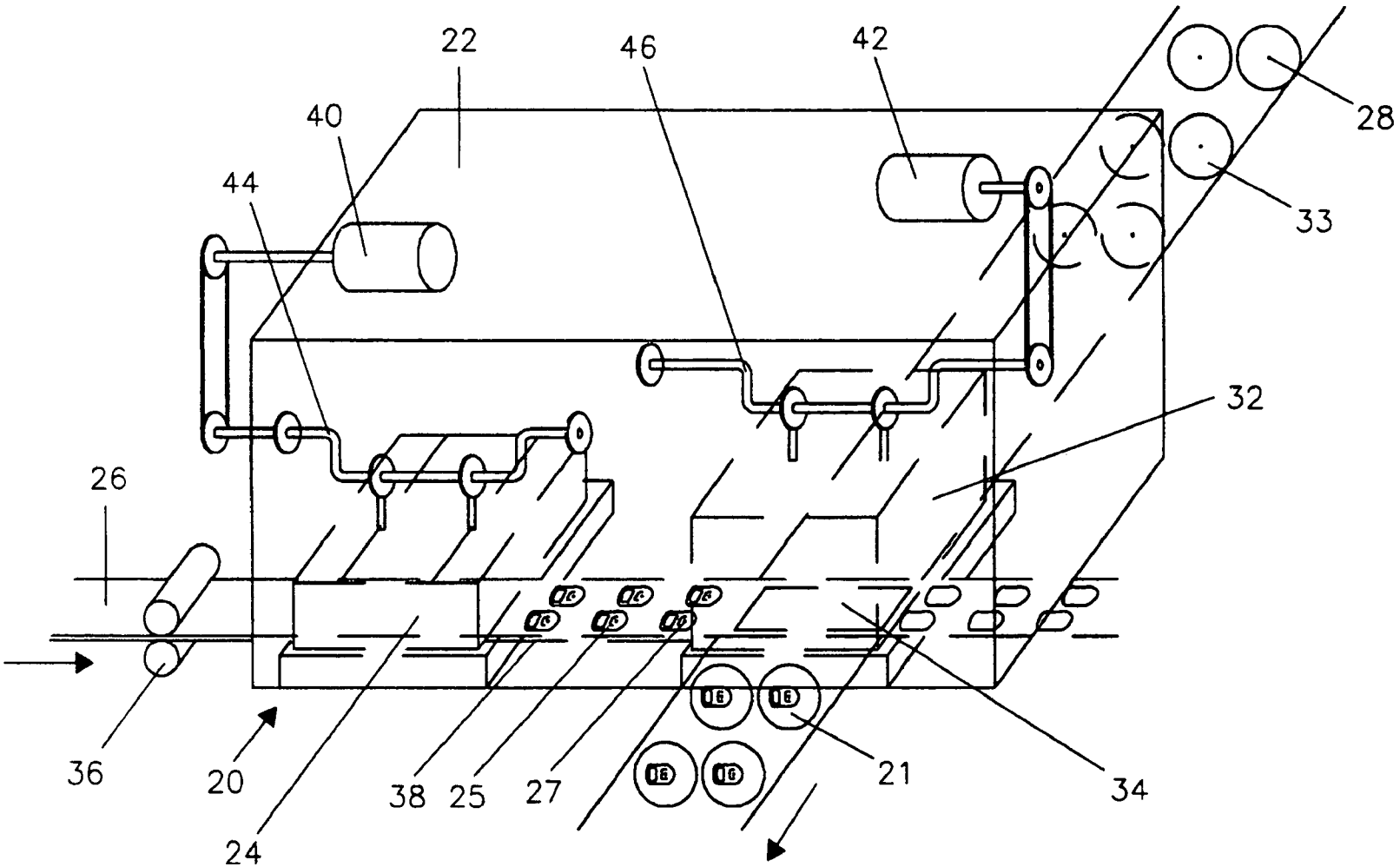
FIG. 1 is a view of a preferred embodiment of the system for forming and attaching lift-tabs to can ends in accordance with the invention showing a tab press, a tab press crank shaft, a tab press power source, a conversion press, a conversion press crank shaft and a conversion press power source mounted on a single frame.

Referring now to the drawings, the preferred embodiments of the system for forming and attaching lift-tabs to can ends to form easy opening lift-tab can ends are illustrated by FIGS. 1 through 11. As shown in FIG. 1, a preferred system for forming and attaching lift-tabs to can ends to form easy opening lift-tab can ends is designated generally by reference numeral 20. The preferred system 20 is adapted to form a plurality of easy opening lift-tab can ends 21. More particularly, the preferred system 20 includes frame 22 and means for forming a lift-tab such as tab press 24. Tab press 24 is mounted on frame 22 and adapted to form at least one lane of lift-tabs 25 in a strip of metal stock material 26. Lift-tabs 25 preferably each include rivet hole 27 which is adapted to receive rivet 28 protruding from each can end 33. While the means for forming a lift-tab is preferably tab press 24, it is contemplated within the scope of the invention that the means for forming a lift-tab may be any suitable device for forming a lift-tab in a strip of metal stock material such as a die having tab tooling and the like.

The preferred system 20 also includes means such as conversion press 32 for attaching a lift-tab onto a can end that is made by a conventional can end press (not shown). Conversion press 32 is mounted on frame 22 and adapted to attach a lift-tab onto can end 33 to form easy opening lift-tab can end 21. The preferred conversion press 32 includes locating means 34 for placing strip of metal stock material 26 into conversion press 32 with a lift-tab 25 being placed into working relationship with a can end 33 so that the conversion press may detach the lift-tab from the strip and attach the lift-tab onto the can end to form an easy opening lift-tab can end 21. More particularly, conversion press 32 is adapted to detach lift-tab 25 from strip of metal stock material 26 and attach the lift-tab onto a can end 33 when rivet 28 is positioned directly below rivet hole 27. Preferably, the conversion press operates in a reciprocal up-and-down motion. In the preferred embodiment, on each upstroke of conversion press 32, can ends 33 are advanced at a predetermined rate or distance such that rivet hole 27 of a tab 25 aligns with rivet 28 of a can end 33. Also in the preferred embodiment, on each downstroke of conversion press 32, a lift-tab 25 is attached onto a can end 33. Thereafter, the formed easy opening lift-tab can end 21 may be removed from the system. While conversion press 32 is the preferred means for attaching a lift-tab onto a can end, it is contemplated within the scope of the invention that the means for attaching a lift-tab onto a can end may be any suitable device for attaching a lift-tab onto a can end such as a die having conversion tooling and the like.

Still referring to FIG. 1, the preferred system 20 also includes drive roller 36. Drive roller 36 is supported on frame 22 and adapted to move strip of metal stock material 26 through the means for forming a lift-tab such as tab press 24. More particularly, drive roller 36 rolls the strip of metal stock material, with the formed lift-tabs loosely attached, across a series of rollers or through a guide. The preferred system 20 further includes conveyor means 38 for conveying the at least one lane of lift-tabs of metal stock material from means for forming a lift-tab to the means for attaching a lift-tab onto a can end such as conversion press 32. It is contemplated within the scope of the invention that the drive roller may also convey the strip of metal stock material to the conversion press.

Referring still to FIG. 1, the preferred system 20 also includes one or more power sources or motors. More particularly, the preferred system 20 includes tab press power source 40 and conversion press power source 42. Tab press power source 40 is adapted to provide power to operate tab press 24. Conversion press power source 42 is adapted to provide power to operate conversion press 32. It is contemplated within the scope of the invention, however, that a single power source may provide power to operate the tab press and the conversion press as discussed below.

As shown in FIG. 1, the preferred system 20 also includes one or more crank shafts. More particularly, the preferred system 20 includes tab press crank shaft 44 and conversion press crank shaft 46. Tab press crank shaft 44 is operatively connected to tab press power source 40 and adapted to transmit power for operating the means for forming a lift-tab such as tab press 24. Conversion press crank shaft 46 is operatively connected to conversion press power source 42 and adapted to transmit power for operating the means for attaching a lift-tab onto a can end such as conversion press 32. As can be appreciated from FIG. 1, tab press 24 may be operated independent of the conversion press 32.

Figure 2:
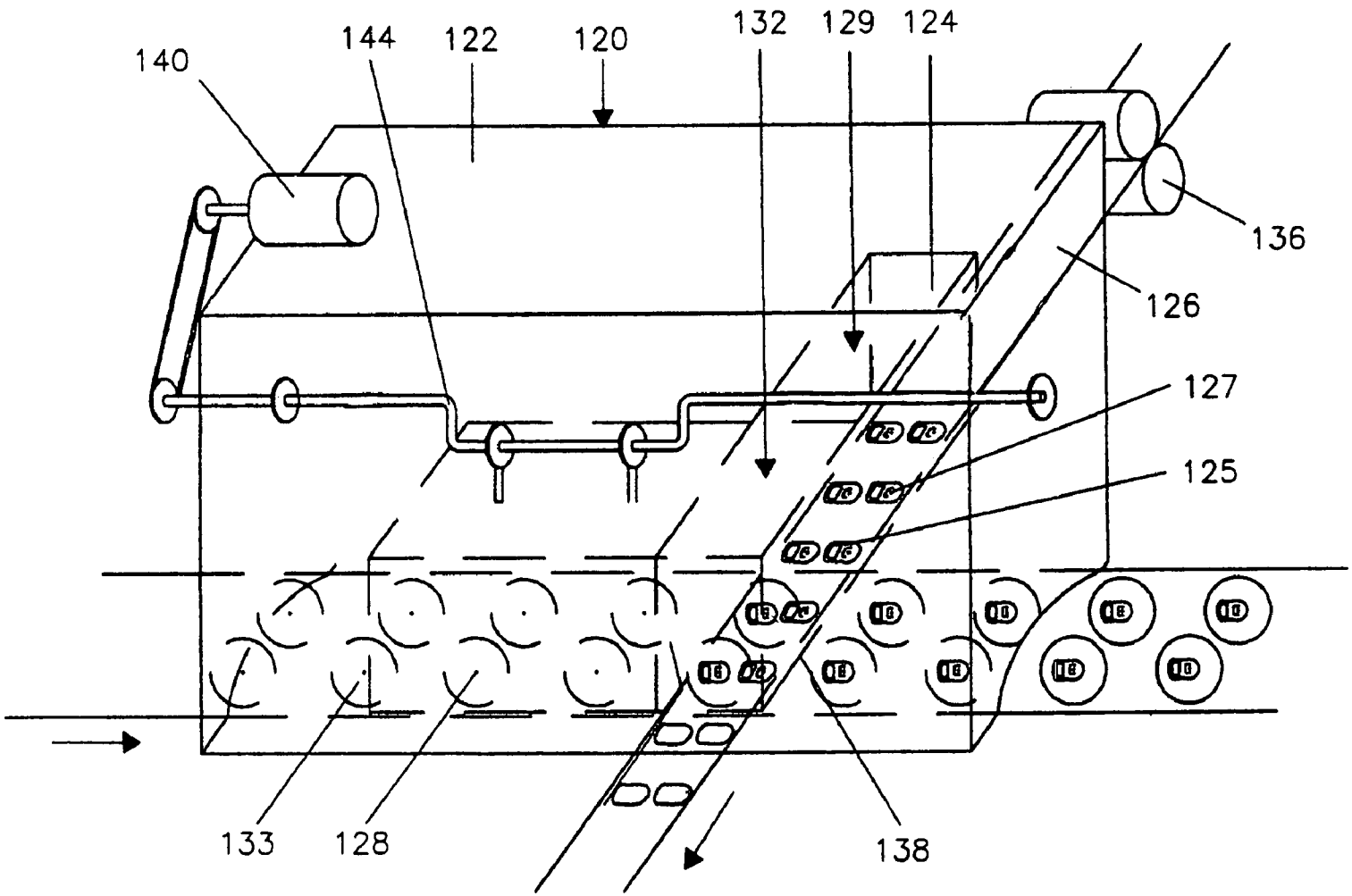
FIG. 2 is a view of a first alternative embodiment of the system for forming and attaching lift-tabs to can ends in accordance with the invention showing a die having tab tooling and conversion tooling, a die crank shaft and a die power source mounted on a single frame.

Referring now to FIG. 2, a first alternative embodiment of the system for forming and attaching lift-tabs to can ends to form easy opening lift-tab can ends is illustrated. More particularly, FIG. 2 illustrates system 120 having frame 122. The means for forming a lift-tab and the means for attaching a lift-tab onto a can end comprise die 124 mounted on frame 122. Die 124 includes tab tooling 129 adapted to form at least one lane of lift-tabs 125 in strip of metal stock material 126 and conversion tooling 132 adapted to attach a lift-tab 125 onto a can end 133. Lift-tabs 125 preferably each include rivet hole 127 which is adapted to receive rivet 128 protruding from each can end 133. As shown in FIG. 2, the preferred system 120 also includes die power source 140 adapted to provide power to operate die 124. The preferred system 120 further includes die crank shaft 144 which is operatively connected to die power source 140 and adapted to transmit power for operating die 124. The preferred system 120 also includes drive roller 136 and conveyor means 138.

Figure 3:
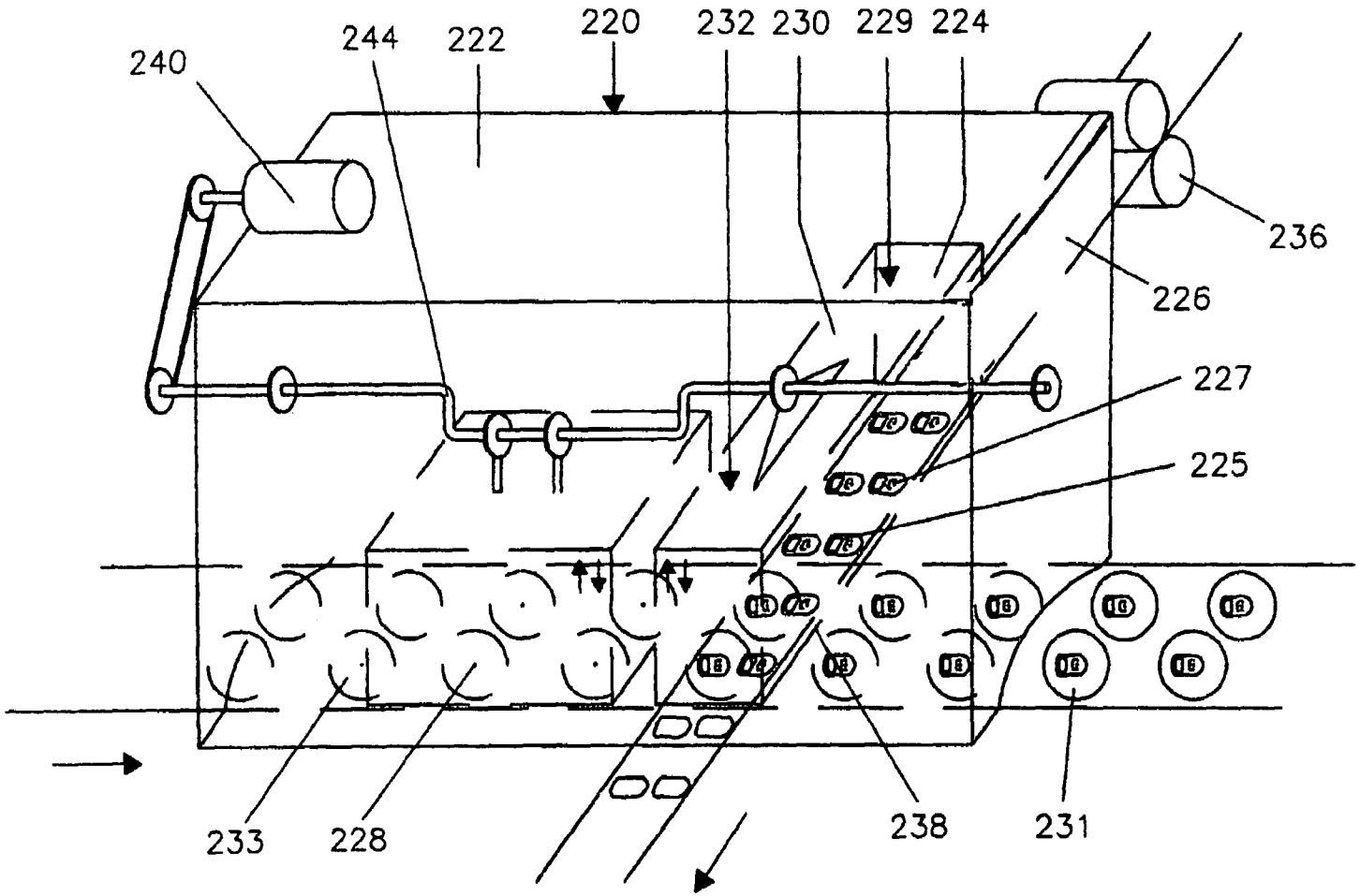
FIG. 3 is a view of a second alternative embodiment of the system for forming and attaching lift-tabs to can ends in accordance with the invention showing a first die having tab tooling, a second die having conversion tooling, a die crank shaft and a die power source mounted on a single frame.

Referring now to FIG. 3, a second alternative embodiment of the system for forming and attaching lift-tabs to can ends to form easy opening lift-tab can ends is illustrated. More particularly, FIG. 3 illustrates system 220 having frame 222. The means for forming a lift-tab comprises first die 224. First die 224 is mounted on frame 222 and has tab tooling 229 adapted to form at least one lane of lift-tabs 225 in strip of metal stock material 226. Lift-tabs 225 preferably each include rivet hole 227 which is adapted to receive rivet 228 protruding from each can end 233. The means for attaching a lift-tab onto a can end comprises second die 230. Second die 230 is mounted on frame 222 and has conversion tooling 232 adapted to attach a lift-tab 225 onto a can end 233. Die power source 240 provides power to operate first die 224 and the second die 230. Die crank shaft 244 is operatively connected to die power source 240 and adapted to transmit power for operating first die 224 and second die 230. The preferred system 220 also includes drive roller 236 and conveyor means 238.

Figure 4:
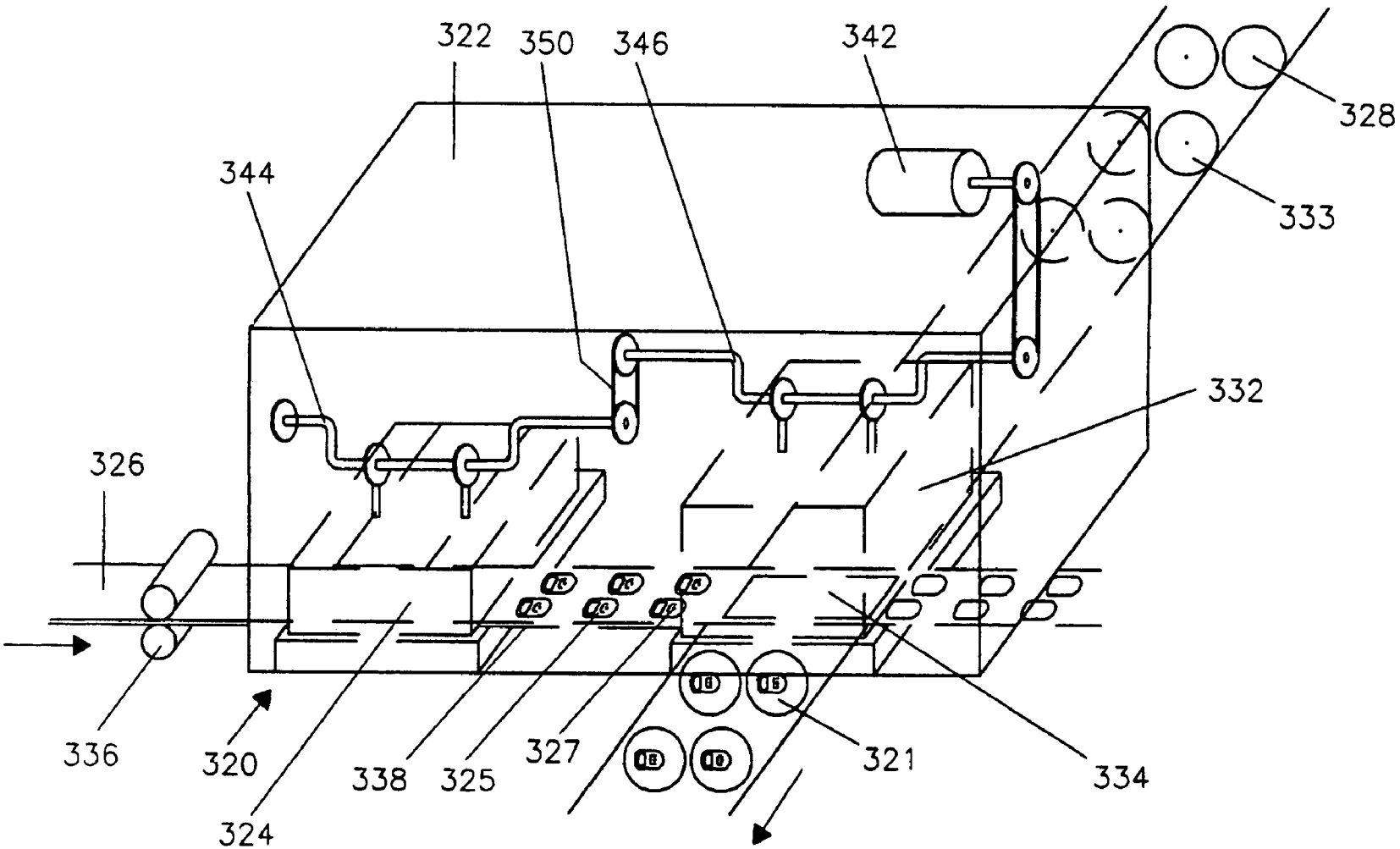
FIG. 4 is a view of a third alternative embodiment of the system for forming and attaching lift tabs to can ends in accordance with the invention showing a tab press, a conversion press, a tab press crank shaft, a conversion press crank shaft and a conversion press power source mounted on a single frame.

Referring now to FIG. 4, a third alternative embodiment of the system for forming and attaching lift-tabs to can ends to form easy opening lift-tab can ends is illustrated. More particularly, FIG. 4 illustrates system 320 having frame 322. The means for forming a lift-tab comprises tab press 324. Tab press 324 is mounted on frame 322 and adapted to form at least one lane of lift-tabs 325 in strip of metal stock material 326. Lift-tabs 325 preferably each include rivet hole 327 which is adapted to receive rivet 328 protruding from each can end 333. The means for attaching a lift-tab onto a can end comprises conversion press 332. Conversion press 332 is mounted on frame 322 and adapted to attach a lift-tab 325 onto a can end 333. Conversion press 332 includes locating means 334 for placing the strip of metal stock material into the conversion press with the lift-tab being placed into working relationship with a can end so that the conversion press may detach the lift-tab from the strip and attach the lift-tab onto the can end to form easy opening lift-tab can end 321.

Still referring to FIG. 4, conversion press power source 342 provides power to operate tab press 324 and conversion press 332. Tab press crank shaft 344 is adapted to transmit power for operating tab press 324. Conversion press crank shaft 346 is operatively connected to conversion press power source 342 and adapted to transmit power for operating conversion press 332. Tab press crank shaft 344 and conversion press crank shaft 346 are connected to each other by drive belt 350. It is contemplated within the scope of the invention, however, that the tab press crank shaft and the conversion press crank shaft may be connected by any suitable device such as a chain and the like. The preferred system 320 also includes drive roller 336 and conveyor means 338.

Figure 5:
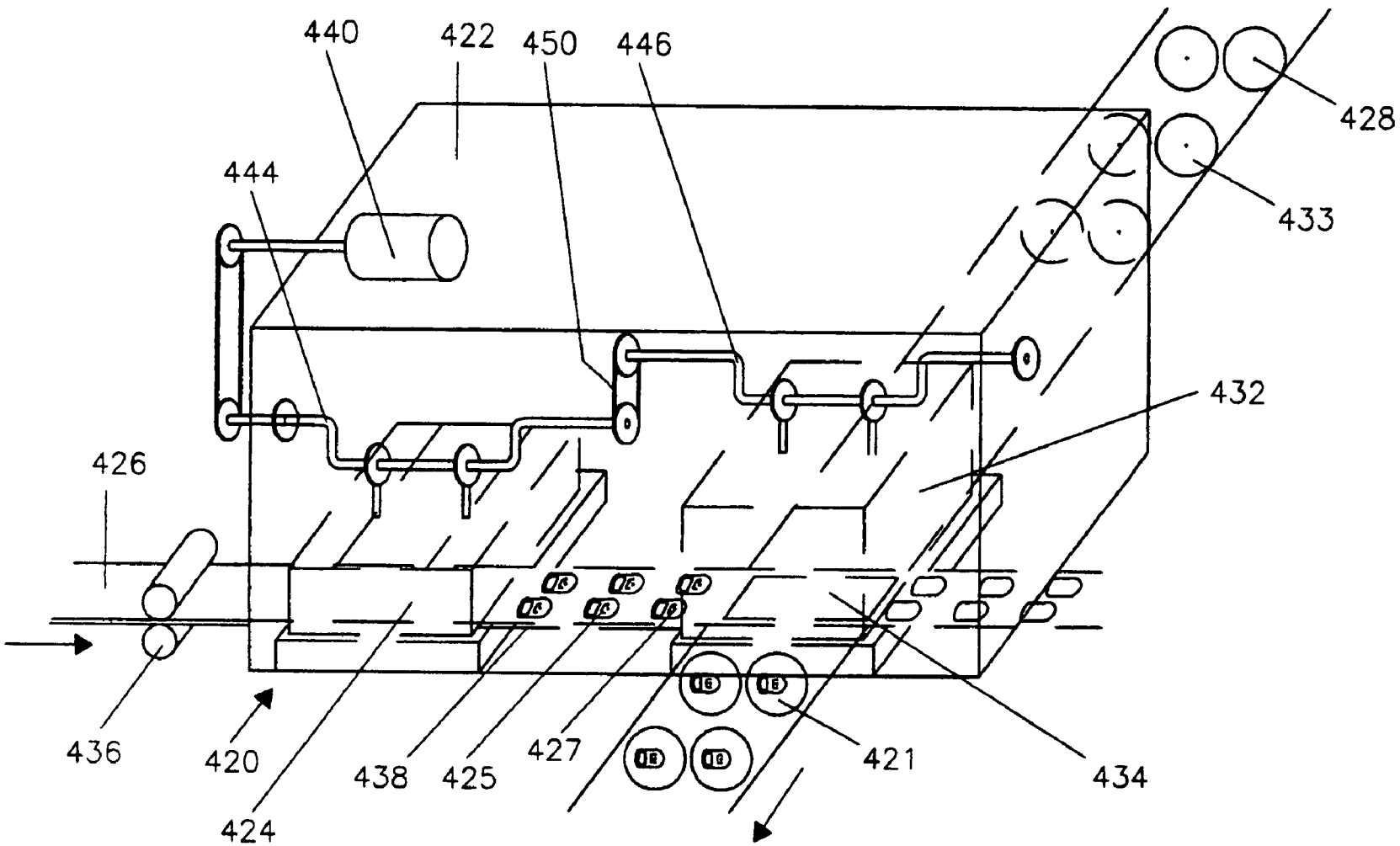
FIG. 5 is a view of a fourth alternative embodiment of the system for forming and attaching lift-tabs to can ends in accordance with the invention showing a tab press, a conversion press, a tab press crank shaft, a conversion press crank shaft and a tab press power source mounted on a single frame.

Referring now to FIG. 5, a fourth alternative embodiment of the system for forming and attaching lift-tabs to can ends to form easy opening lift-tab can ends is illustrated. More particularly, FIG. 5 illustrates system 420 having frame 422.

The means for forming a lift-tab comprises tab press 424. Tab press 424 is mounted on frame 422 and adapted to form at least one lane of lift-tabs 425 in strip of metal stock material 426. Lift-tabs 425 preferably each include rivet hole 427 which is adapted to receive rivet 428 protruding from each can end 433. The means for attaching a lift-tab onto a can end comprises conversion press 432. Conversion press 432 is mounted on frame 422 and adapted to attach a lift-tab 425 onto a can end 433. Conversion press 432 includes locating means 434 for placing the strip of metal stock material into the conversion press with the lift-tab being placed into working relationship with a can end so that the conversion press may detach the lift-tab from the strip and attach the lift-tab onto the can end to form easy opening lift-tab can end 421.

Still referring to FIG. 5, tab press power source 440 provides power to operate tab press 424 and conversion press 432. Tab press crank shaft 444 is operatively connected to tab press power source 440 and adapted to transmit power for operating tab press 424. Conversion press crank shaft 446 is adapted to transmit power for operating conversion press 432. Tab press crank shaft 444 and conversion press crank shaft 446 are connected to each other by drive belt 450. It is contemplated within the scope of the invention, however, that the tab press crank shaft and the conversion press crank shaft may be connected by any suitable device such as a chain and the like. The preferred system 420 also includes drive roller 436 and conveyor means 438.

Figure 6:
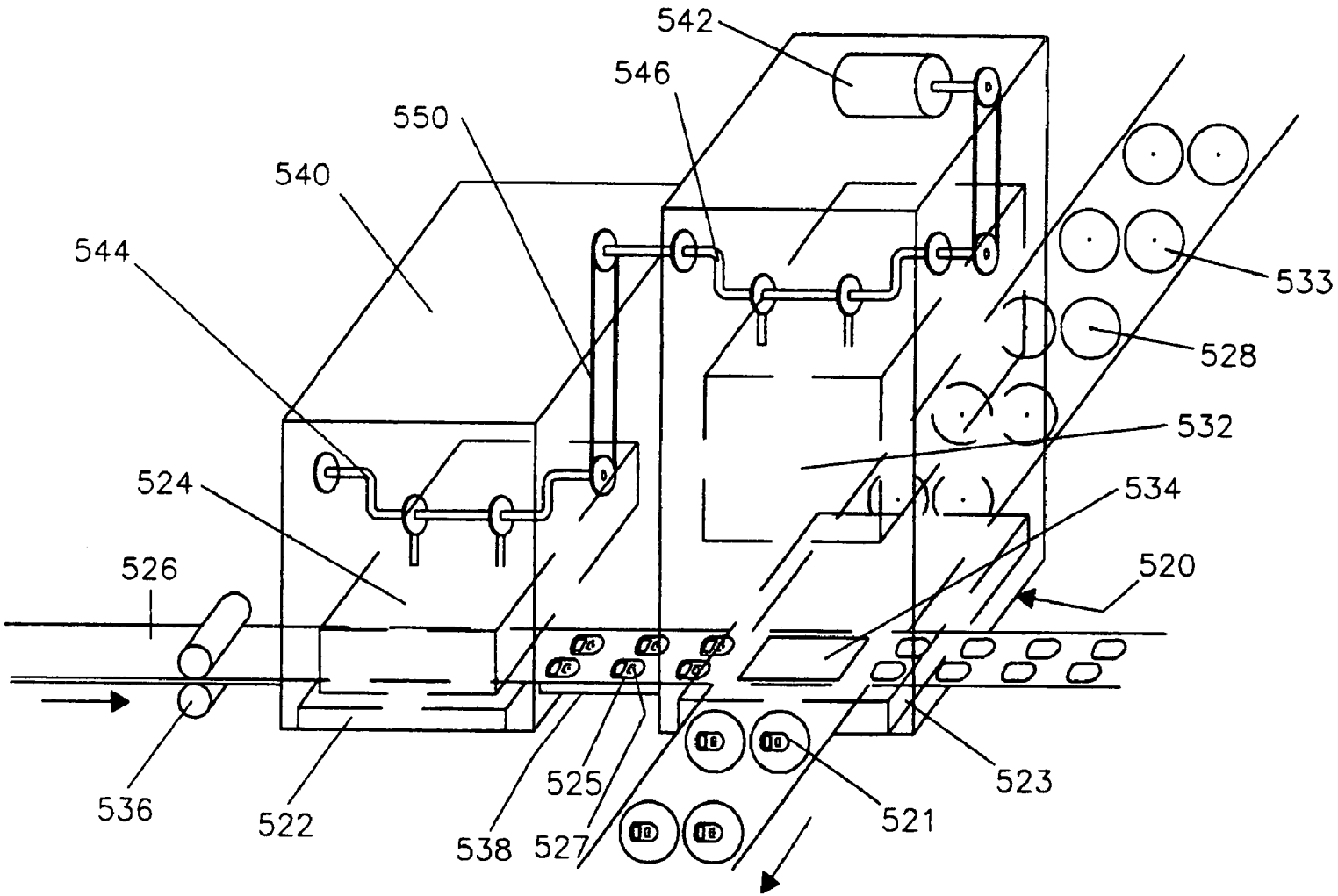
FIG. 6 is a view of a fifth alternative embodiment of the system for forming and attaching lift-tabs to can ends in accordance with the invention showing a tab press mounted on a first frame, a tab press crank shaft, a conversion press mounted on a second frame, a conversion press crank shaft and a conversion press power source.

Referring now to FIG. 6, a fifth alternative embodiment of the system for forming and attaching lift-tabs to can ends to form easy opening lift-tab can ends is illustrated. More particularly, FIG. 6 illustrates system 520 which includes first frame 522 and second frame 523. Second frame 523 is in close proximity to first frame 522. The preferred system 520 also includes tab press 524. Tab press 524 is mounted on first frame 522 and adapted to form at least one lane of lift-tabs 525 in a strip of metal stock material 526. Lift-tabs 525 preferably each include rivet hole 527 which is adapted to receive rivet 528 protruding from each can end 533. The preferred system 520 further includes conversion press 532. Conversion press 532 is mounted on second frame 523 and adapted to attach a lift-tab 525 onto a can end 533. Conversion press 532 also includes locating means 534 for placing the strip of metal stock material into the conversion press with the lift-tab being placed into working relationship with a can end so that the conversion press may detach the lift-tab from the strip and attach the lift-tab onto the can end to form easy opening lift-tab can end 521.

Still referring to FIG. 6, conversion press power source 542 provides power to operate tab press 524 and conversion press 532. Tab press crank shaft 544 is adapted to transmit power for operating tab press 524. Conversion press crank shaft 546 is operatively connected to conversion press power source 542 and adapted to transmit power for operating conversion press 532. Tab press crank shaft 544 and conversion press crank shaft 546 are connected to each other by drive belt 550. It is contemplated within the scope of the invention, however, that the tab press crank shaft and the conversion press crank shaft may be connected by any suitable device such as a chain and the like. The preferred system 520 also includes drive roller 536 and conveyor means 538.

Figure 7:
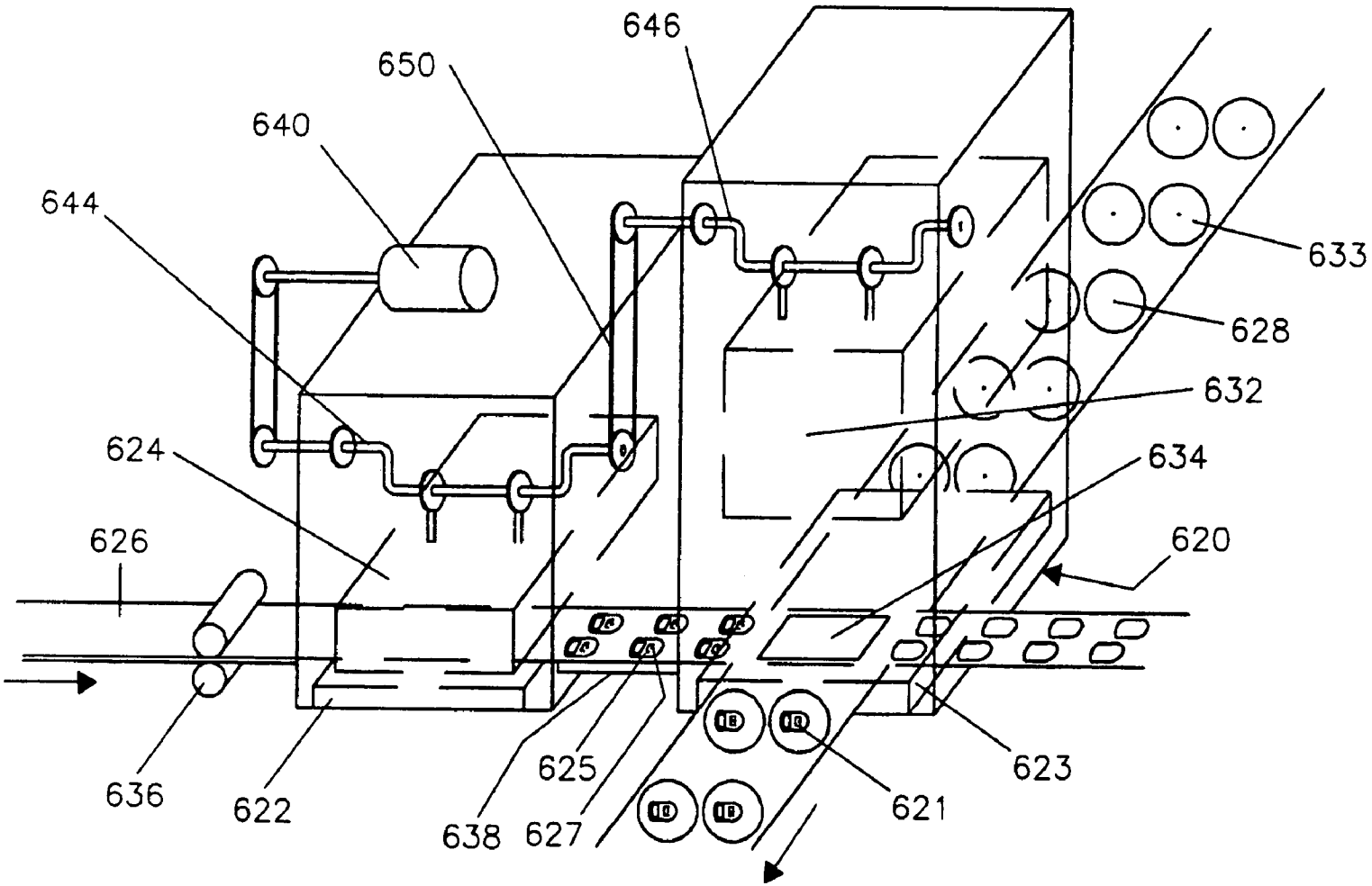
FIG. 7 is a view of a sixth alternative embodiment of the system for forming and attaching lift-tabs to can ends in accordance with the invention showing a tab press mounted on a first frame, a tab press crank shaft, a tab press power source, a conversion press mounted on a second frame and a conversion press crank shaft.

Referring now to FIG. 7, a sixth alternative embodiment of the system for forming and attaching lift-tabs to can ends to form easy opening lift-tab can ends is illustrated. More particularly, FIG. 7 illustrates system 620 which includes first frame 622 and second frame 623. Second frame 623 is in close proximity to first frame 622. The preferred system 620 also includes tab press 624. Tab press 624 is mounted on first frame 622 and adapted to form at least one lane of lift-tabs 625 in a strip of metal stock material 626. Lift-tabs 625 preferably each include rivet hole 627 which is adapted to receive rivet 628 protruding from each can end 633. The preferred system 620 further includes conversion press 632. Conversion press 632 is mounted on second frame 623 and adapted to attach a lift-tab 625 onto a can end 633. Conversion press 632 also includes locating means 634 for placing the strip of metal stock material into the conversion press with the lift-tab being placed into working relationship with a can end so that the conversion press may detach the lift-tab from the strip and attach the lift-tab onto the can end to form easy opening lift-tab can end 621.

Still referring to FIG. 7, tab press power source 640 provides power to operate the tab press and the conversion press. Tab press crank shaft 644 is operatively connected to tab press power source 640 and adapted to transmit power for operating tab press 624. Conversion press crank shaft 646 is adapted to transmit power for operating conversion press 632. Tab press crank shaft 644 and conversion press crank shaft 646 are connected to each other by drive belt 650. It is contemplated within the scope of the invention, however, that the tab press crank shaft and the conversion press crank shaft may be connected by any suitable device such as a chain and the like. The preferred system 620 also includes drive roller 636 and conveyor means 638.

Figure 8:
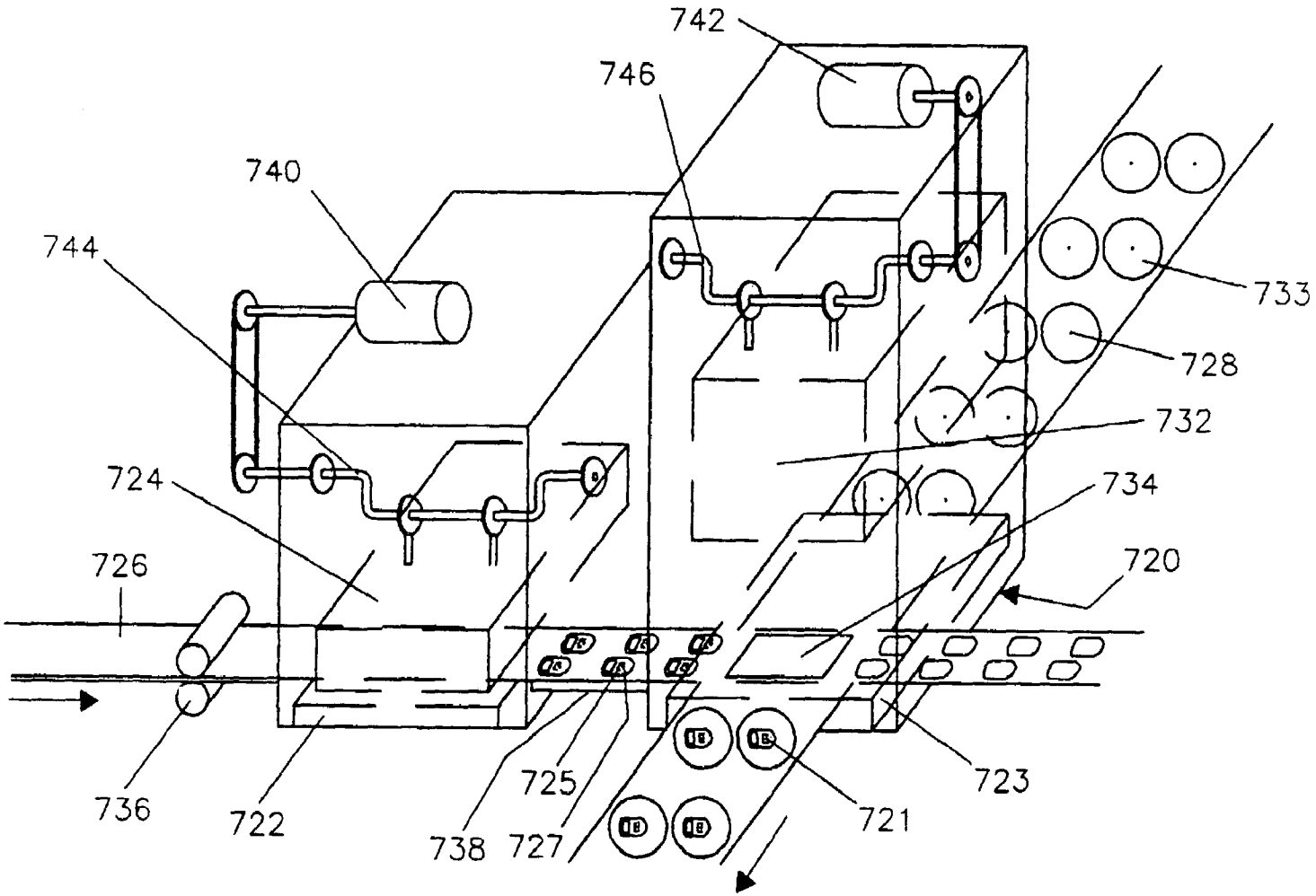
FIG. 8 is a view of a seventh alternative embodiment of the system for forming and attaching lift-tabs to can ends in accordance with the invention showing a tab press mounted on a first frame, a tab press crank shaft, a tab press power source, a conversion press mounted on a second frame, a conversion press crank shaft and a conversion press power source.

Referring now to FIG. 8, a seventh alternative embodiment of the system for forming and attaching lift-tabs to can ends to form easy opening lift-tab can ends is illustrated. More particularly, FIG. 8 illustrates system 720 which includes first frame 722 and second frame 723. Second frame 723 is in close proximity to first frame 722. The preferred system 720 also includes tab press 724. Tab press 724 is mounted on first frame 722 and adapted to form at least one lane of lift-tabs 725 in a strip of metal stock material 726. Lift-tabs 725 preferably each include rivet hole 727 which is adapted to receive rivet 728 protruding from each can end 733. The preferred system 720 further includes conversion press 732. Conversion press 732 is mounted on second frame 723 and adapted to attach a lift-tab 725 onto a can end 733. Conversion press 732 also includes locating means 734 for placing the strip of metal stock material into the conversion press with the lift-tab being placed into working relationship with a can end so that the conversion press may detach the lift-tab from the strip and attach the lift-tab onto the can end to form easy opening lift-tab can end 721.

Still referring to FIG. 8, tab press power source 740 provides power to operate tab press 724. Conversion press power source 742 provides power to operate conversion press 732. Tab press crank shaft 744 is operatively connected to tab press power source 740 and adapted to transmit power for operating tab press 724. Conversion press crank shaft 746 is operatively connected to conversion press power source 742 and adapted to transmit power for operating conversion press 732. First frame 722 and second frame 723 are connected by bridge 752. The preferred system 720 also includes drive roller 736 and conveyor means 738.

Figure 9:
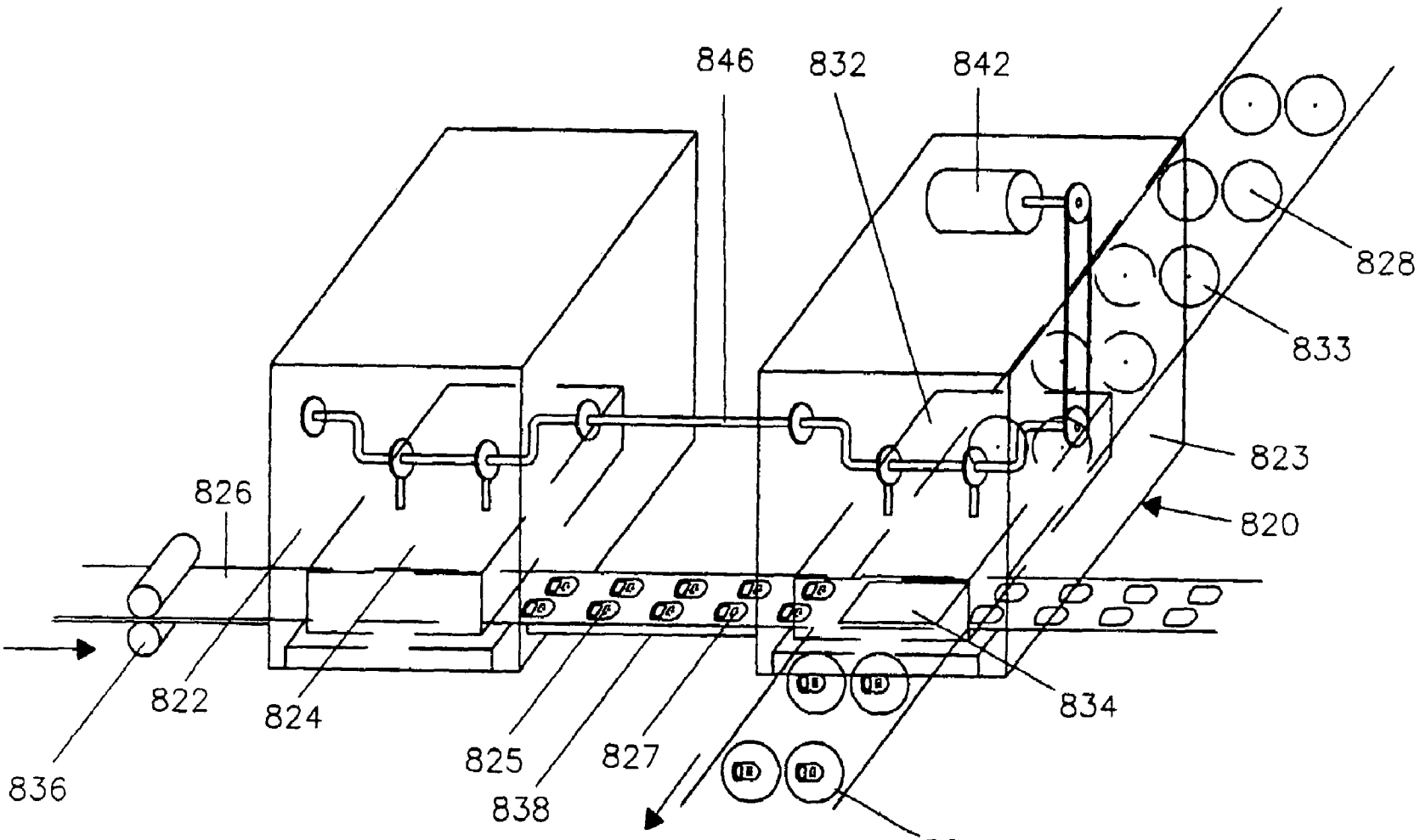
FIG. 9 is a view of an eighth alternative embodiment of the system for forming and attaching lift-tabs to can ends in accordance with the invention showing a tab press mounted on a first frame, a conversion press mounted on a second frame, an elongated crank shaft and a conversion press power source.

Referring now to FIG. 9, an eighth alternative embodiment of the system for forming and attaching lift-tabs to can ends to form easy opening lift-tab can ends is illustrated. More particularly, FIG. 9 illustrates system 820 which includes first frame 822 and second frame 823. Second frame 823 is in close proximity to first frame 822. The preferred system 820 also includes tab press 824. Tab press 824 is mounted on first frame 822 and adapted to form at least one lane of lift-tabs 825 in a strip of metal stock material 826. Lift-tabs 825 preferably each include rivet hole 827 which is adapted to receive rivet 828 protruding from each can end 833. The preferred system 820 further includes conversion press 832. Conversion press 832 is mounted on second frame 823 and adapted to attach a lift-tab 825 onto a can end 833. Conversion press 832 also includes locating means 834 for placing the strip of metal stock material into the conversion press with the lift-tab being placed into working relationship with a can end so that the conversion press may detach the lift-tab from the strip and attach the lift-tab onto the can end to form easy opening lift-tab can end 821.

Still referring to FIG. 9, conversion press power source 842 provides power to operate tab press 824 and conversion press 832. Elongated crank shaft 846 is operatively connected to conversion press power source 842. Elongated crank shaft 846 extends to tab press 824 and conversion press 832 and is adapted to transmit power for operating the tab press and the conversion press. The preferred system 820 also includes drive roller 836 and conveyor means 838.

Figure 10:
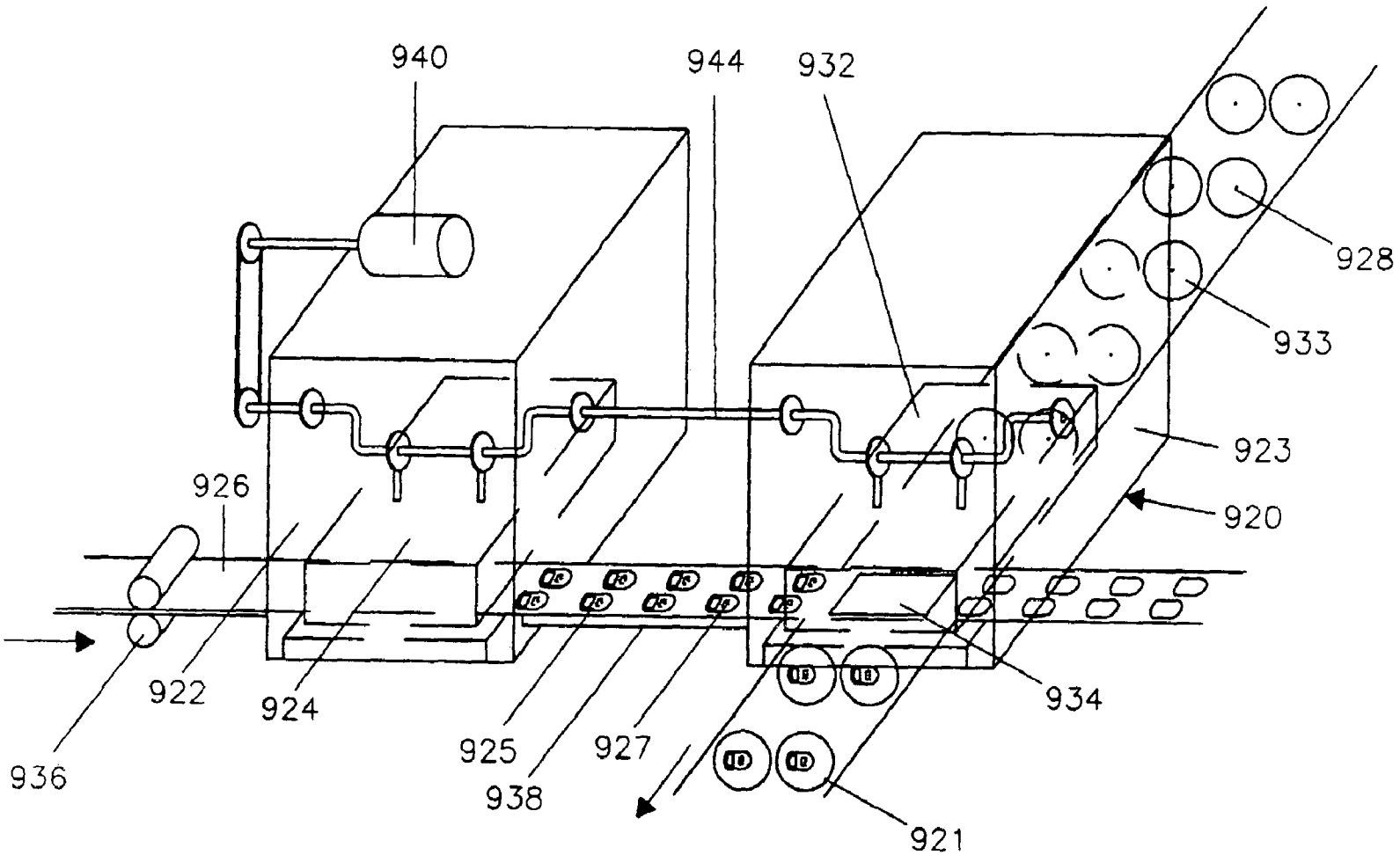
FIG. 10 is a view of a ninth alternative embodiment of the system for forming and attaching lift-tabs to can ends in accordance with the invention showing a tab press mounted on a first frame, a conversion press mounted on a second frame, an elongated crank shaft and a tab press power source.

Referring now to FIG. 10, a ninth alternative embodiment of the system for forming and attaching lift-tabs to can ends to form easy opening lift-tab can ends is illustrated. More particularly, FIG. 10 illustrates system 920 which includes first frame 922 and second frame 923. Second frame 923 is in close proximity to first frame 922. The preferred system 920 also includes tab press 924. Tab press 924 is mounted on first frame 922 and adapted to form at least one lane of lift-tabs 925 in a strip of metal stock material 926. Lift-tabs 925 preferably each include rivet hole 927 which is adapted to receive rivet 928 protruding from each can end 933. The preferred system 920 further includes conversion press 932. Conversion press 932 is mounted on second frame 923 and adapted to attach a lift-tab 925 onto a can end 933. Conversion press 932 also includes locating means 934 for placing the strip of metal stock material into the conversion press with the lift-tab being placed into working relationship with a can end so that the conversion press may detach the lift-tab from the strip and attach the lift-tab onto the can end to form easy opening lift-tab can end 921.

Still referring to FIG. 10, tab press power source 940 provides power to operate tab press 924 and conversion press 932. Elongated crank shaft 944 is operatively connected to tab press power source 940. Elongated crank shaft 944 extends to tab press 924 and conversion press 932 and is adapted to transmit power for operating the tab press and the conversion press. The preferred system 920 also includes drive roller 936 and conveyor means 938.

Figure 11:
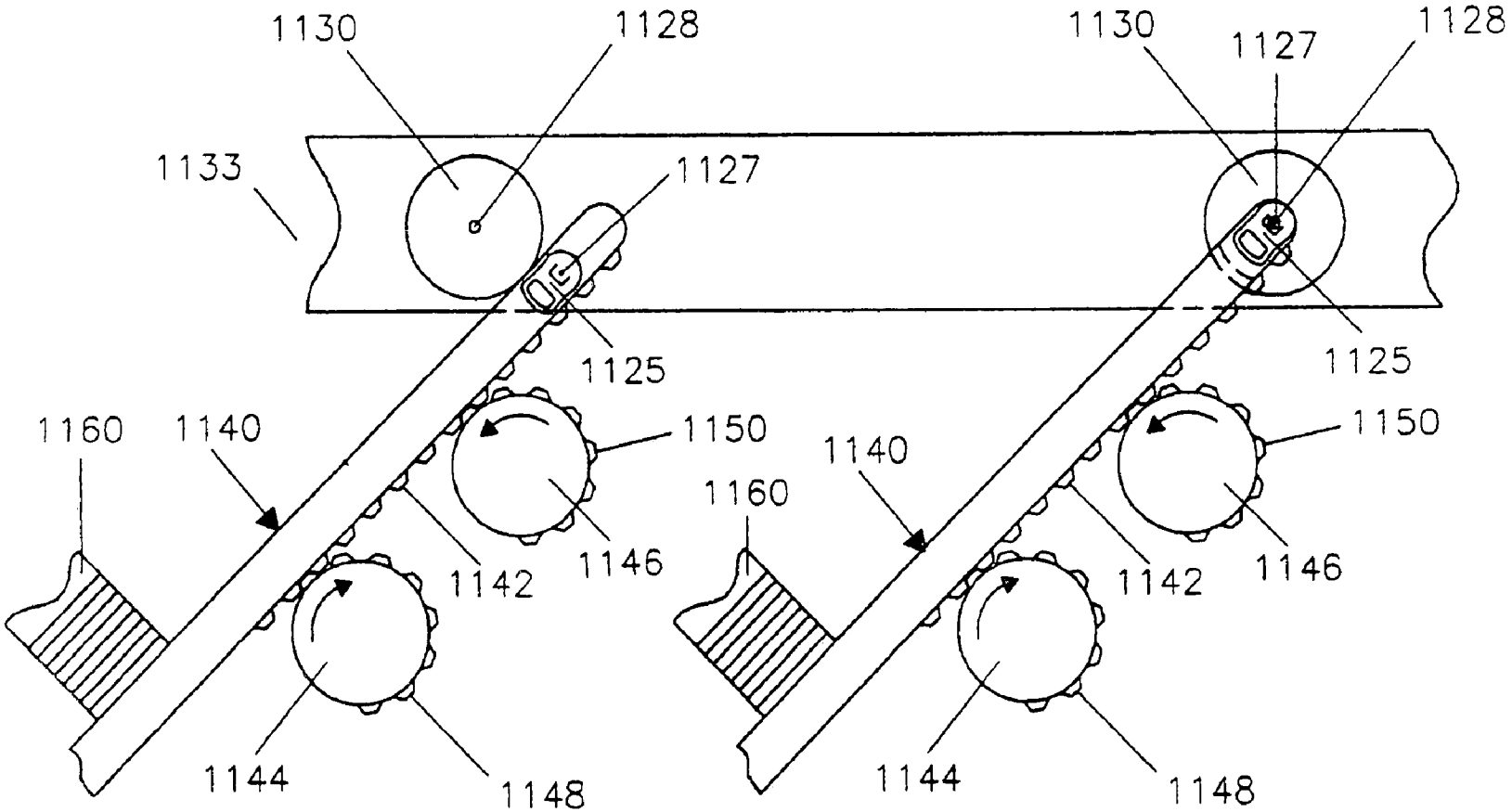
FIG. 11 is a schematic representation of a preferred embodiment of a tab ejector utilized in a preferred embodiment of a conversion press in accordance with the invention.

Referring now to FIG. 11, a schematic representation of a preferred embodiment of a tab ejector utilized in a preferred embodiment of a conversion press in accordance with the present invention is illustrated. More particularly, FIG. 11 illustrates preferred tab ejector 1133. It is contemplated within the scope of the invention that the preferred tab ejector may be mounted on the first frame or the second frame (not shown). The preferred tab ejector 1133 is adapted to feed one lift-tab 1125 at a time into a conversion press (not shown). More particularly, the preferred tab ejector 1133 is adapted to position a lift-tab 1125 relative to a can end 1130 such that the lift-tab will be properly attached to the can end upon the next downstroke of the conversion press.

In order for the tab ejector to properly position a lift-tab 1125 with respect to a can end 1130, a locating or positioning means is used and may operate as follows: As lift-tabs 1125 are punched or removed from metal strip (not shown) they will be collected in at least one chute 1160. The bottom of chute 1160 is positioned adjacent to the conversion press. As the exposed can ends 1130 are advanced through the conversion press, tab ejector 1133 slides the lift-tab 1125 which is at the bottom of chute 1160 to a predetermined position relative to the conversion press. This predetermined position of lift-tab 1125 allows for proper positioning of rivet hole 1127 of lift-tab 1125 and rivet 1128 of can end 1130. The conversion press then downstrokes to rivet lift-tab 1125 to can end rivet 1128. As the conversion press upstrokes, the next can end 1130 is advanced into the bed of the conversion press and tab ejector 1133 positions the next lift-tab 1125 over the upwardly-protruding rivet 1128 formed in can end 1130.

The preferred embodiment of tab ejector 1133 comprises a lift-tab seat (not shown) and slide 1140 which are positioned just slightly higher than can end 1130 in conversion press 1132. The preferred tab ejector 1133 slides lift-tab 1125 along slide 1140 into a predetermined position at which point the lift-tab seat (not shown) is pulled from under lift-tab 1125 which allows lift-tab rivet hole 1127 to drop onto upwardly protruding can end rivet 1128. The movement of slide 1140 of tab ejector. 1133 is preferably accomplished by the use of gear receiver track 1142 and two gear wheels 1144, 1146 each being devoid of teeth along one-half of its outer circumference. Gear wheels 1144 and 1146 turn in opposite directions so that as slide 1140 moves toward the predetermined position, the slide stops because teeth 1148 in gear 1144 run out of track 1142 and teeth 1150 on gear 1146 come into contact with track 1142, thereby moving slide 1140 in the opposite direction and returning the slide to the chute 1160 of lift-tabs 1125. The inward and outward sliding of slide 1140 is repeated once for each downstroke of the conversion press.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A system for forming and attaching lift-tabs to can ends to form easy opening lift-tab can ends, wherein each of said can ends includes a rivet to which a lift-tab may be attached, said system comprising:

a frame;

a means for forming a lift-tab, said means for forming a lift-tab being mounted on the frame and adapted to form at least one lane of lift-tabs in a strip of metal stock material;

a drive roller supported on the frame and adapted to move the strip of metal stock material through the means for forming a lift-tab;

a means for attaching a lift-tab onto a can end, said means for attaching a lift-tab onto a can end being mounted on the frame and adapted to attach a lift-tab onto a can end to form an easy opening lift-tab can end, and wherein the means for attaching a lift-tab onto a can end includes a conversion press mounted on the frame, said conversion press having a locating means for placing the strip of metal stock material into the conversion press with the lift-tab being placed into working relationship with a can end so that the conversion press may detach the lift-tab from the strip and attach the lift-tab onto the can end to form an easy opening lift-tab can end;

a conveyor means for conveying the at least one lane of formed lift-tabs from the means for forming a lift-tab to the means for attaching a lift-tab onto a can end;

a power source for providing power to operate either or both of the means for forming a lift-tab and the means for attaching a lift-tab onto a can end, and wherein the power source includes a means for forming a lift-tab power source for providing power to operate the means for forming a lift-tab and the conversion press; and a crank shaft operatively connected to the power source, said crank shaft being adapted to transmit power for operating either or both of the means for forming a lift-tab and the means for attaching a lift-tab onto a can end, and wherein the crank shaft includes a means for forming a lift-tab crank shaft that is operatively connected to the means for forming a lift-tab power source and adapted to transmit power for operating the means for forming a lift-tab and a conversion press crank shaft that is adapted to transmit power for operating the conversion press; and wherein, the means for forming a lift-tab crank shaft and the conversion press crank shaft are connected to each other by a drive belt.

2. The system of claim 1 wherein the means for attaching a lift-tab onto a can end includes said conversion press having a tab ejector mounted on the frame, said conversion press being adapted to attach a lift tab onto a can end and said tab ejector being adapted to feed one lift-tab at a time into said conversion press.

* * * * *